United States Patent [19]

McCree

[11] Patent Number: 5,009,828

[45] Date of Patent: Apr. 23, 1991

[54] METHOD OF FORMING A RECLOSABLE CONTAINER WITH GRIP STRIP

[75] Inventor: John O. McCree, Midland, Mich.

[73] Assignee: The Dow Chemical Company, Midland, Mich.

[21] Appl. No.: 419,975

[22] Filed: Oct. 11, 1989

Related U.S. Application Data

[63] Continuation of Ser. No. 781,125, Sep. 26, 1985, abandoned.

[51] Int. Cl.[5] ..... B29C 47/12

[52] U.S. Cl. ..... 264/177.1; 156/66; 156/244.11; 156/244.25; 264/177.16; 264/177.17; 264/177.19; 264/210.1; 425/461

[58] Field of Search ..... 264/177.1, 177.16, 177.17, 264/210.1, 167, 177.19; 425/461; 156/244.25, 244.11, 66

[56] References Cited

U.S. PATENT DOCUMENTS

| | | | |
|---|---|---|---|
| 3,104,937 | 9/1963 | Wyckoff et al. | 264/210.1 |
| 3,994,654 | 11/1976 | Chyu | 425/461 |
| 4,076,121 | 2/1978 | Clayton et al. | 264/177.1 |
| 4,101,620 | 7/1978 | Kops et al. | 264/177.16 |
| 4,363,345 | 12/1982 | Scheibner | 383/35 |
| 4,515,647 | 5/1985 | Behr | 264/167 |
| 4,521,368 | 6/1985 | Mercer et al. | 264/167 |

FOREIGN PATENT DOCUMENTS

| | | | |
|---|---|---|---|
| 0089680 | 9/1983 | European Pat. Off. | 383/65 |
| 43-24560 | 10/1968 | Japan | 264/177.1 |

*Primary Examiner*—Jeffery Thurlow

[57] ABSTRACT

A method of forming a plurality of small ridges located in a strip across the lip of a reclosable plastic bag is provided. The method produces a wide ridged surface area to permit ready gripping of the lip of the bag when opening the bag and separating the reclosable feature.

7 Claims, 2 Drawing Sheets

FIG-1
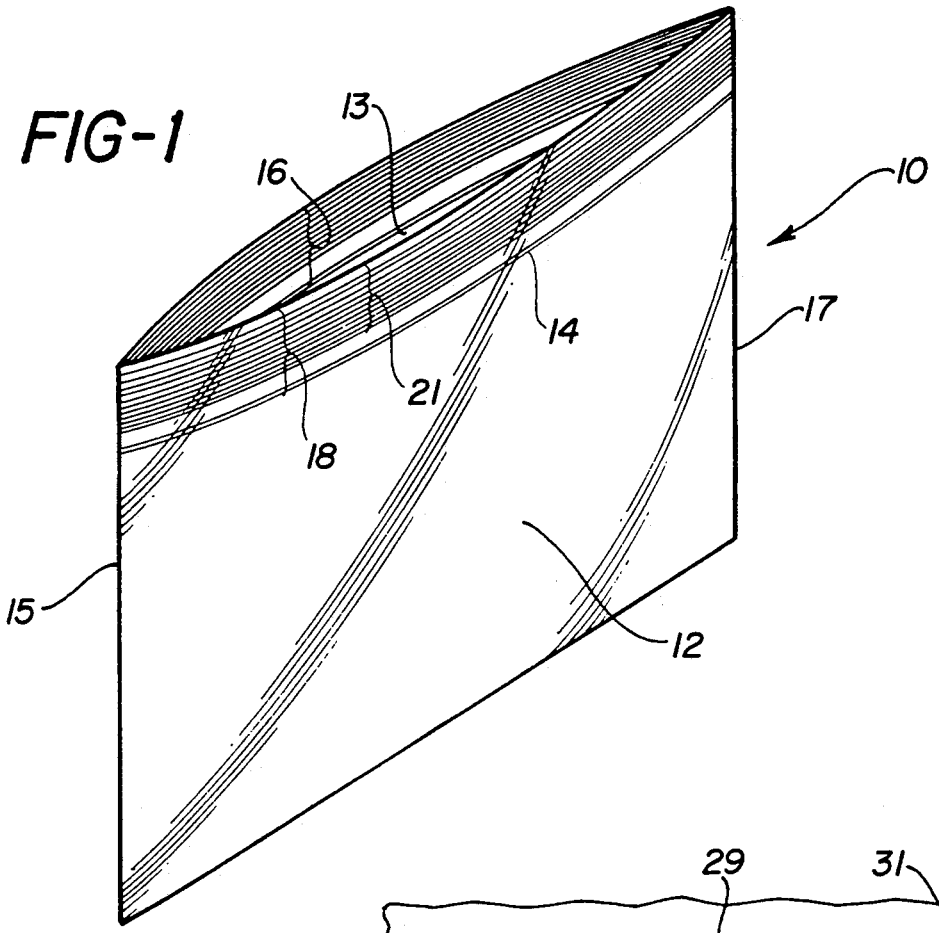
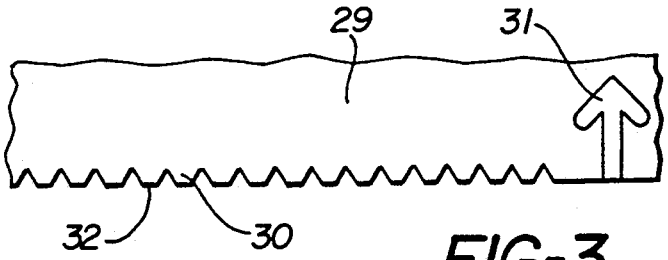
FIG-3
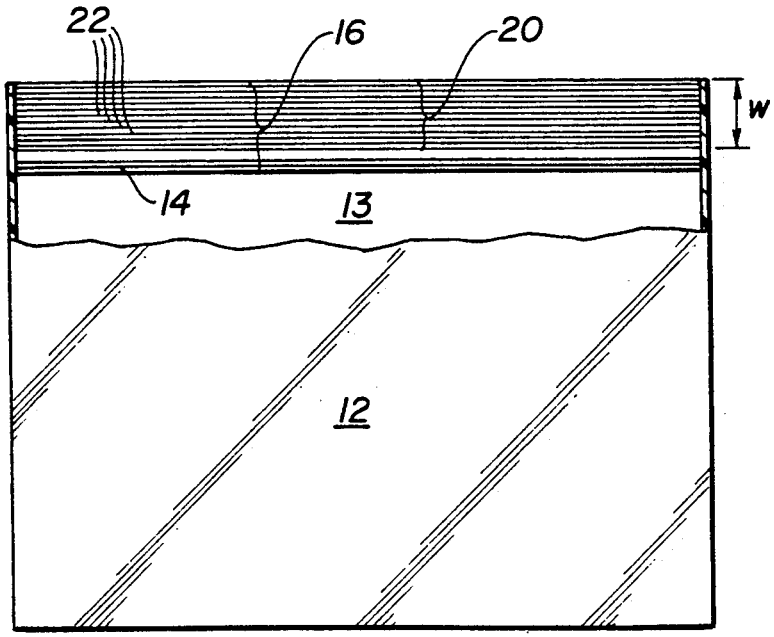
FIG-2

METHOD OF FORMING A RECLOSABLE CONTAINER WITH GRIP STRIP

CROSS-REFERENCE TO RELATED APPLICATION

This is a continuation of application Ser. No. 781,125, filed Sept. 26, 1985 now abandoned.

This invention involves a method of forming a plurality of small ridges located in a strip across the lip of a reclosable plastic bag providing a wide ridged surface area to permit ready gripping of the lip of the bag when opening the bag and separating the reclosable feature.

BACKGROUND OF THE INVENTION

In reclosable plastic bags or other containers, particularly those containing a zipper type reclosable closure such as taught in U.S. Pat. No. 4,263,079, the container usually carries lips located above the reclosable closure feature, which lips are required to be grasped between the thumb and a finger, for example, and pulled to open the closure. Some degree of force is necessary to open the closure, which is relatively secure to avoid accidental opening. Since such bags are often found in the kitchen, it is not uncommon for one's fingers to be greasy. Since lips of such bags are commonly formed from smooth films such as those formed of polyolefin resin, the ease with which the lips of the bag can be grasped and kept hold of while pulling during opening can be easily negated when the fingers are greasy. Attempts to solve the lip grasping problem have generally included one, two or three large ribs, which are close to the same size as the closure elements themselves, such as illustrated in U.S. Pat. No. 4,363,345, for example. Such large ribs are purported to improve gripping of the container lips by the user during the opening and loading of the container. However, use of large ribs has been found to cause some forming complications because of their size, in that undulations can occur during extrusion. Such large ribs have also been found in many instances not to be as comfortable to the user as they might be, some effort is required on the part of the user to locate the large ribs and such large ribs require considerable amount of resin material to form especially if more than one or two of them are employed.

Other references that teach only slightly roughened opposing surfaces in film containers such as found in U.S. Pat. Nos. 2,197,113 and 3,113,715 are designed primarily to prevent blocking so that the bags are easier to open or to provide a means of venting air from the inside of the container for vacuum packaging, and are not designed to nor effectively provide a gripping function for grasping by fingers.

What the Applicants have found is that a far more desirable, improved arrangement is where the size and the number of protuberance are in between those that are merely employed for roughening a surface as a spacing means for non blocking and those ribs which are large and small in number, such as previously designed to aid in gripping of lips of reclosable plastic bags.

SUMMARY OF THE INVENTION

The present invention is an improvement to a method of forming reclosable plastic containers, such as bags, ensuring ease of grasping of the lips of bags both from a location and securing standpoint, the improvement simultaneously leading to ease of manufacture of such containers containing such improved grasping feature, hereinafter called grip strips. This improvement is accomplished by modifying the lip of a reclosable bag by including on opposed surfaces thereof a plurality of generally parallel small ridges in order to provide a large area of ridged surface to grip the top or lip of the bag when opening or filling the bag. It has also been found that when a larger number of ridges are used, the ridges can be considerably smaller than when a single rib is employed and still produce an improved gripping surface. It has further been found that a plurality of small ridges are easier to produce than fewer large ribs. Small ridges require less modification to the die when added to the film by extrusion. In addition, small ridges can be produced by other techniques than extrusion such as by embossing, and a plurality of such small ridges can also provide reinforcement for the lip of the bag. It has been discovered that a series of generally parallel ridges presenting a gripping edge or edges and being about 0.002 to 0.009 (preferably 0.003 to 0.005) inches in height and spaced at a density of about 7 to 24 (preferably 12 to 16) ridges per lineal inch of film in the region above the reclosable feature would provide the advantages of this invention.

BRIEF DESCRIPTION OF THE DRAWINGS

FIG. 1 is a perspective view of a reclosable bag with improved grip strips of this invention;

FIG. 2 is a side elevational view of the bag of FIG. 1 partially broken away to show a grip strip on the inside of one lip;

FIG. 3 is a partial plan view of an extrusion die employed for extruding the ridges forming the grip strip on a lip of the bag shown in FIG. 1;

DETAILED DESCRIPTION OF THE DRAWING

Figure 4:
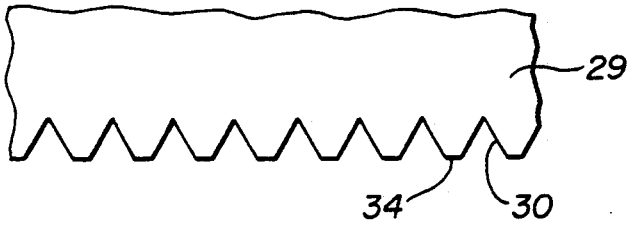
FIG. 4 is an enlarged fragmentary plan view of the lower edge of the die plate shown in FIG. 3.

Referring more particularly to FIG. 1, there is shown a container or bag 10 having opposed side walls 12 and 13, reclosable fastener elements 14, opposed lips 16 and 18, each opposed lip containing grip strips 20 and 21 respectively, which grip strips provide for improved ease of opening and holding the bag for filling. FIG. 2 is a view like FIG. 1 showing through a broken away section the inside of side 13 of the bag 10 with its lip 16 and grip strip 20, the latter comprising a plurality of elongated generally parallel ridges 22 extending from substantially one edge 15 of the bag to the other edge 17 as a strip or band across lip 16 above reclosable fastener 18. Ridges 22 are preferably substantially continuous along their length.

Bag 10 can be formed in a process such as shown and described in U.S. Pat. No. 4,515,647, assigned to the same assignee as is the present invention, with the cut-away 30 of a die 29 for grip strip ridges 22 being located to the outside of the extrusion openings 31 of each profile extrusion such as shown in fragmentary FIG. 3. Cut-away 30 in the front or lower edge of the die 29 form teeth-like die projections 32 being shown in somewhat exaggerated detail for clarity. The cut-aways 30 which form the ridges 22 of grip strip 20 for example, are shown to be of a triangular configuration so as to provide ridges 22 with a generally triangular configuration, as shown in FIG. 6, for example and described in more detail later.

Figure 8D:
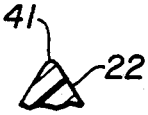
FIG. 8D shows an enlarged cross-section of the ridge of 7D, and FIG. 8E being an enlarged cross-section of the ridge of FIG. 7E.
Figure 8E:
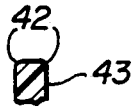

In greatly enlarged FIG. 4 a land 34 between cut-aways 30 is purposely not as great as the spacing "x" between the tips 23 of adjacent ridges 22. Again, as seen in the grip strip 20 in FIG. 6, as compared to the cut-aways 30 in die 29, because of the draw down occurring in the extrusion process, the land area 34 (FIG. 4) between cut-aways 30, which form ridges 22, is greatly extended to the distance roughly shown as about "x" minus the width "w" of one ridge 22 (FIG. 6). Not only is the spacing between the ridges 22 effected by the draw-down in the extrusion process, but also the particular shape of each of the ridges 22 as disclosed hereinafter. The cut-away openings 30 can take various configurations approaching a rectangle, all the way to a saw tooth type opening, such as a right triangular configuration or take the shape of a equilateral triangle. Preferably a shape is desired which can present at least an edge to be engaged by a finger or a thumb when gripping the lip to open the bag containing a grip strip 20, such as shown in gripping edge 41 of ridge 22 in FIG. 8D or gripping edges 42 of ridge 43 in FIG. 8E, which edges are shown slightly rounded because some rounding occurs in draw-down during the extrusion process.

Figure 5:
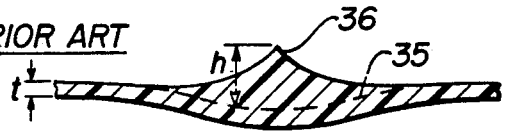
FIG-5 PRIOR ART
FIG. 5 is an enlarged cross-sectional view of a grip lip having a single ridge as typically employed in the prior art.

FIG. 5 illustrates a grip lip 36 of the prior art which has a film thickness "t" of about two to three thousandths of an inch (0.002 to 0.003), and a grip lip height "h" of from two to five-hundredths of an inch (0.02 to 0.05). There generally are only one or two such ribs 36 on a grip lip.

Figure 6:
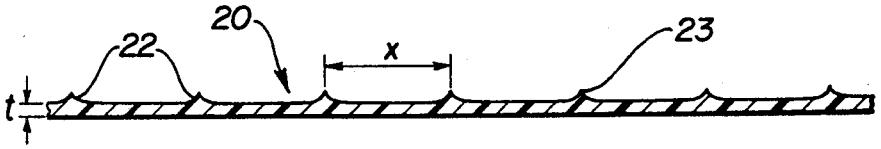
FIG. 6 is a view like FIG. 5 only showing a grip strip with a plurality of ridges formed in accordance with the principles of the present invention and manufactured using the die plate of FIG. 3.
Figure 7A:
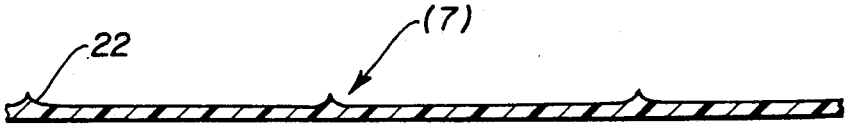
FIGS. 7A–7E is a cross-sectional view of various embodiments of grip strips of the present invention showing some variation in ridge spacing, shape and size.
Figure 7B:
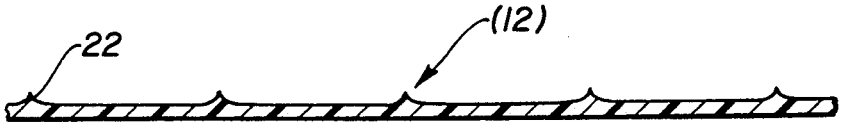
Figure 7C:
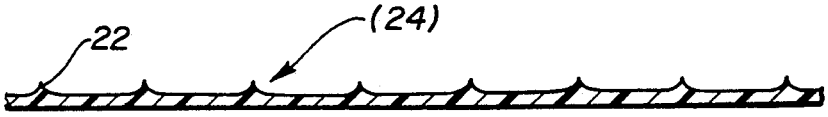
Figure 7D:
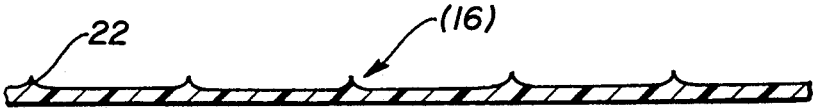
Figure 7E:
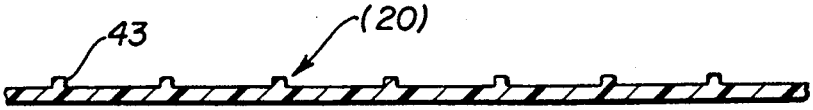

In the grip strip cross-section shown in FIG. 6, the film thickness "t" can be about the same as that in FIG. 5, that is about two to three thousandths of an inch thick (0.002 to 0.003), but the ridges are only about two to nine thousands of an inch (0.002 to 0.009) tall and they are spaced at a density of about 12 to 16 ridges per lineal inch of film across the grip strips width w, which in the illustration shown in FIG. 6 gives a spacing x of about 0.06 to 0.08 inches from tip 23 to tip 23 of adjacent ridges 22.

Various modifications of this invention are shown in FIGS. 7A–7E, for example, all on about the same scale (50 times actual size) as that used for FIGS. 5 and 6, the various ridge heights and ridge spacing. While all of these embodiments are operable (the embodiments of FIGS. 7B through 7E were actually made), if there was a preference it would be for the embodiment of FIG. 7D. The number (7) for FIG. 7A, (12) for FIG. 7B, (24) for FIG. 7C, (16) for 7D, and (20) for 7E gives the number of ridges 22 or ridges 43 per inch of film being about 7 to 24 (preferably 12 to 16), 16 ribs per inch of film and with ridges from about 0.002 to about 0.009 inches tall preferably, 0.003 to 0.005 inches tall. If one goes much below 0.002 inches in height ridges became difficult to feel. While a higher ridge may be easier to feel, it requires more material to form and is more difficult to form, as explained earlier.

It has been found that using a plurality of much smaller ridges 22 as shown in grip strip 20 of FIG. 6, that no more material need be used than used with a single grip strip on a bag lip such as shown in FIG. 5, and yet several advantages are obtained over such a configuration. For one it was found that it was easier to match the flow velocity of the grip strip area with that of the film during extrusion when a series of small ridges are used and that this essentially eliminated undulation extrusion problems of the kind that are experienced when trying to match the velocity of a single relatively large grip lip rib, such as rib 36, to that of the flat film being coextruded therewith. Another advantage of using a plurality of small ridges is that there was provided uniform gripping essentially over the entire lip. Not only does a grip strip according to this invention provide a better feel, but it is more fool proof because one can grip the lip anywhere and find more than one ridge upon which to engage fingers for pulling zippers or other reclosable elements apart or holding the bag even with greasy fingers. In one survey taken, for example when comparing the grip strip of the present invention, with the prior art with a single large rib on each bag lip of those surveyed with dry hands only 29 percent preferred the prior art grip lip as against 63 percent for the grip strip of this invention, while 8 percent thought that they were about equally effective. With greasy hands, the numbers were 25 percent, 72 percent and 3 percent, respectively showing an overwhelming preference for the grip strip of this invention, especially with greasy hands where the test is the most severe.

While certain representative embodiments details have been shown for purposes of illustrating the invention, it will be apparent to those skilled in the art that various changes can be made without departing from the spirit and scope of the invention. For example, the resin materials may vary and this might possibly effect the feel and gripping power of ridges and the spacing of the ridges during draw-down and yet the concept of a plurality of smaller ridges versus much fewer larger ridges would still fall within the scope of the present claims.

What is claimed is:

1. A method of forming a reclosable container with gripping ridges formed in a grip strip on opposed lips of the container, said method comprising the steps of forming three or more cut-away sections on an extrusion die adapted to form ridges on film coextruded adjacent said ridges, said cut-away sections spaced a distance so that there are at least seven ridges per lineal inch in the width of said grip strip, said cut-away sections shaped so as to present a gripping edge on said ridges, extruding said ridges through said extrusion die onto a plastic film to form said grip strip, and drawing down said grip strip so as to maintain generally said gripping edge and said at least seven ridges per lineal inch of said grip strip.

2. The method of claim 1, wherein said cut-away sections include land areas between each of said cut-away sections.

3. The method of claim 1, wherein said ridges are generally parallel to one another.

4. The method of claim 1, wherein said step of drawing down said grip strip produces ridges having a height of from about 0.003 to 0.005 inches.

5. A method of claim 1, wherein said step of drawing down said grip strip produces from 7 to 24 ridges per lineal inch across the width of said grip strip.

6. The method of claim 1, wherein said draw-down and amount of cut-away are effected so that the height of said ridges in the resulting container is no greater than about 0.009 inches but no less than about 0.002 inches.

7. The method of claim 1, wherein there are from 12 to 16 of said cut-away sections provided on said die.

* * * * *